US010760570B2

(12) United States Patent
Voit et al.

(10) Patent No.: US 10,760,570 B2
(45) Date of Patent: Sep. 1, 2020

(54) STATOR-ROTOR SYSTEM AND METHOD FOR ADJUSTING A STATOR IN A STATOR-ROTOR SYSTEM

(71) Applicant: NETZSCH Pumpen & Systeme GmbH, Selb (DE)

(72) Inventors: Stefan Voit, Amerang (DE); Christian Kneidl, Waldkraiburg (DE); Hisham Kamal, Waldkraiburg (DE); Christian Bindig, Wunsiedel (DE); Mikael Tekneyan, Kraiburg am Inn (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 397 days.

(21) Appl. No.: 15/547,400

(22) PCT Filed: Jan. 29, 2016

(86) PCT No.: PCT/DE2016/000032
§ 371 (c)(1),
(2) Date: Jul. 28, 2017

(87) PCT Pub. No.: WO2016/119774
PCT Pub. Date: Aug. 4, 2016

(65) Prior Publication Data

US 2018/0010603 A1 Jan. 11, 2018

(30) Foreign Application Priority Data

Jan. 29, 2015 (DE) ..... 10 2015 101 352

(51) Int. Cl.
*F04C 2/107* (2006.01)
*F01C 21/10* (2006.01)

(52) U.S. Cl.
CPC ..... *F04C 2/1075* (2013.01); *F01C 21/102* (2013.01); *F04C 2250/30* (2013.01)

(58) Field of Classification Search
CPC .. F01C 21/102; F04C 2250/30; F04C 2/1075; F04C 2240/81; F04C 2240/811;
(Continued)

(56) References Cited

U.S. PATENT DOCUMENTS 3,139,035 A 6/1964 O'Connor
3,499,389 A 3/1970 Seeberger et al.
(Continued)

FOREIGN PATENT DOCUMENTS

DE 2331173 A1 1/1975
DE 3433269 A1 3/1986
(Continued)

OTHER PUBLICATIONS

International Search Report Application No. PCT/DE2016/000032 Completed Date: May 6, 2016; dated May 18, 2016 7 pages.
(Continued)

*Primary Examiner* — Patrick Hamo
*Assistant Examiner* — Paul W Thiede
(74) *Attorney, Agent, or Firm* — Whitmyer IP Group LLC

(57) ABSTRACT

A stator-rotor system of an eccentric screw pump including a rotor with a rotor screw and a stator with an internal thread. The stator includes a support element and an elastomer part. The support element surrounds the elastomer part in sections around the whole circumference. The stator-rotor system includes a mechanism for adjusting the stator, having two adjustment elements arranged on the stator-rotor system, which are distance-variable relative to one another. In a first working position the two adjustment elements have a first distance from one another and in a second working position, a second distance. The cross-section and the length of the elastomer part of the stator in the second working position are changed compared to the cross-section and the length of the elastomer part in the first working position.

17 Claims, 4 Drawing Sheets

(58) Field of Classification Search
CPC .. F04C 2270/175; F04C 2/1071; F04C 14/20; F04C 18/107; F04C 18/1075; F04C 28/18; F04C 28/20; F04C 230/60
USPC ..... 418/48, 1, 152, 153
See application file for complete search history.

(56) References Cited

U.S. PATENT DOCUMENTS

| | | | | |
|---|---|---|---|---|
| 8,007,259 | B2 * | 8/2011 | Kreidl | F04C 2/1075 418/48 |
| 2015/0118085 | A1 * | 4/2015 | Lessmann | F04C 2/1073 418/1 |
| 2017/0268505 | A1 * | 9/2017 | Dicks | F04C 18/107 |
| 2018/0010604 | A1 * | 1/2018 | Voit | F04C 2/1075 |

FOREIGN PATENT DOCUMENTS

| | | | |
|---|---|---|---|
| DE | 3641855 | A1 | 6/1988 |
| DE | 279043 | A1 | 5/1990 |
| DE | 4312123 | A1 | 10/1994 |
| DE | 4403979 | A1 | 8/1995 |
| DE | 10200393 | A1 | 7/2003 |
| DE | 102005042559 | A1 | 3/2007 |
| EP | 0292594 | A1 | 11/1988 |
| FR | 1155632 | A | 5/1958 |

OTHER PUBLICATIONS

Written Opinion of the International Searching Authority Application No. PCT/DE2016/000032 Completed Date: Jan. 29, 2016 5 pages.

* cited by examiner

STATOR-ROTOR SYSTEM AND METHOD FOR ADJUSTING A STATOR IN A STATOR-ROTOR SYSTEM

TECHNICAL FIELD

The present invention relates to a stator-rotor system and a method for adjusting a stator in a stator-rotor system.

BACKGROUND

The present invention relates to a stator-rotor system of an eccentric screw pump for delivering liquid and/or granular media with an adjustable or readjustable stator.

Eccentric screw pumps are pumps for delivering a plurality of media, in particular viscous, highly viscous and abrasive media such as for example sludges, manure, crude oil and greases. The driven helical rotor moves along in rolling contact in the stator. The latter is a housing with a helically coiled inner side. The rotor performs with its figure axis an eccentric rotary motion around the stator axis. The outer screw, i.e. the stator, has for example the form of a double-lead thread, whereas the rotor screw is only single-lead. The rotor is usually made from a highly abrasion-resistant material, such as steel for example. The stator, on the other hand, is made from an elastic material, for example rubber. As a result of the special formation of rotor and stator, sealed hollow spaces are formed between rotor and stator, said hollow spaces moving along axially as the rotor rotates and delivering the medium. The volume of the hollow spaces is constant, so that the delivery medium is not squashed. With a suitable design, not only fluids, but also solids can be delivered with eccentric screw pumps.

For the formation of the delivery spaces and in order to deliver the given medium with as small a backflow as possible, the rotor lies subject to pressure against an internal wall of the stator formed by an elastic material. On account of the motion of the usually metallic rotor inside the stator usually made of rubber or a similar material, there is a certain amount of abrasion or wear on the stator. As a result of the wear, the pressure-induced contact force is reduced, in particular the contact between the stator and the rotor along an uninterrupted helical contact line cannot be maintained, as a result of which the performance of the eccentric screw pump declines. This applies in particular to pumps which have to overcome a high level of suction. For this reason, the stator has to be exchanged and replaced at regular intervals.

In order to ascertain the time for the replacement of the stator, use is made for example of sensors which detect the wear on the stator on the basis of physical parameters.

Alternatively, embodiments are known, wherein the stator can be readjusted to compensate for the wear. For example, the tension in the stator-rotor system can be adapted by changing the stator diameter.

FIG. 1 shows a diagrammatic partial view of a known stator-rotor system 1 for an eccentric screw pump. Such a system 1 comprises a usually metallic, single-lead helical rotor (not represented) and a stator 3 with a double-lead thread. During the operation of the eccentric screw pump, the rotor performs with its figure axis an eccentric rotary motion about stator longitudinal axis X3. Stator 3 comprises an elastomer part 4 and a stator casing 5 as a support element, wherein there is no fixed connection between elastomer part 4 and stator casing 5.

DE 3433269 A1 describes a stator casing with tensioning devices in the form of tensioning bolts, which are distributed over the entire axial length of the stator casing. This brings about a considerable increase in the weight of the stator-rotor system. In addition, all the tensioning devices have to be individually tightened up for the readjustment.

DE 3641855 A1 describes an adjustable stator with an elastomer body, which is vulcanised in a tubular casing split up at the periphery into segments by the longitudinal slots, and at least one tensioning clamp surrounding the tubular casing.

EP 0292594 A1 discloses a stator casing provided with a longitudinal slot for eccentric screw pumps, which comprises a tensioning device for generating pressure solely in its compression region and for the readjustment in the event of wear on the stator. The tensioning is distributed in part over the length of the stator casing by means of suitable reinforcing ribs.

DE 4312123 A1 describes a stator casing with a plurality of longitudinally running slots, which simplify the readjustment. In order that a readjustment can be better carried out in the region of the pressure-side end of the stator, the slots end shortly before the end of the suction-side end of the stator and run out freely only at the pressure-side end.

DE 4403979 A1 discloses a readjustable stator for eccentric screw pumps with continuous longitudinal slots and longitudinal slots which end at a small distance before the suction-side end of the stator. A continuous slot expediently follows a longitudinal slot in each case.

DE 10200393 A1 describes an eccentric screw pump with a partially tensionable stator. Here, an axially non-continuous tensioning gap is provided in the stator casing surrounding the elastomer stator core. The stud remaining on the entry side forms a tensioning lock on this side. The re-tensioning of the stator takes place by means of a tightening device, which is arranged in the region of the stator casing with a tensioning gap.

Furthermore, according to DE 2331173, a device is known wherein a readjustment of the stator takes place by a partial compression of the stator elastomer on specific lines or points of the stator. For this purpose, the stator comprises helical strips in regions having a particularly high degree of wear. As a result of the displacement of the helical strips, the regions of the inner threaded surface of the stator formed, in cross-section, by the rectilinear sections are in particular changed in their position in the radial direction. Even a severely worn stator lining can thus be deformed in such a way that it again assumes its original cross-sectional shape.

A further possibility makes provision such that a liquid is compressed between the wall of a stator casing and the elastomer part, as a result of which the stator diameter is changed. According to a variant described in U.S. Pat. No. 3,139,035, fluid is introduced into inflatable tubes, as a result of which the pressure on the rotor is increased.

The described prior art has a number of drawbacks. The handling in each given instance is made difficult by the many adjustment options on the various systems. In the described systems, there is in particular no feedback concerning the level of tension between stator and rotor. The adjustment should therefore only be carried out by experienced operatives, because otherwise the risk of incorrect operation is high. If the tension is increased too high, the pump works less well and the wear on the stator is further increased.

With the previously described systems, only compensation of the stator wear is possible, but not an adaptation to the operating conditions prevailing in the given instance.

The problem of the invention is to design the tensioning force of the elastomer of the stator with respect to the rotor in a variable manner in the stator-rotor system of the eccentric screw pump, in order to compensate for the wear on the stator, and wherein the backflow can be kept small even after a long period in operation. Furthermore, influences of the medium on the elastomer in the system should be able to be compensated for.

The above problem is solved by a stator-rotor system and a method for readjusting a stator in a stator-rotor system, which comprise the features in claims 1 and 12. Further advantageous developments are described in the sub-claims.

SUMMARY

The invention relates to a stator-rotor system for an eccentric screw pump. Such a stator-rotor system comprises a rotor with a rotor screw and a stator with an internal thread. The stator can for example be constituted in two parts and can in particular comprise a support element, for example a stator casing, and an elastomer part, wherein the elastomer part of the stator is arranged in the support element or stator casing and does not have a fixed connection to the support element or stator casing. Since no fixed connection between the elastomer part of the stator and the support element or stator casing is present, the latter can be moved against one another. In particular, a displacement along the stator longitudinal axis is possible. Alternatively, a fabric surrounding the elastomer part can be used as a support element. That is to say that the support element or the stator casing and the elastomer part are preferably constituted as separate parts. The support element or the stator casing surrounds the elastomer part at least in sections around the whole circumference. In particular, the support element or the stator casing surrounds the major part of the elastomer part, so that only the free outer end regions of the elastomer part project beyond the support element or the stator casing and are not surrounded by the latter.

In particular, the stator is a stator system such as is described in DE 102005042559 A1. As a result of the absence of a fixed connection between the elastomer part and the support element or stator casing, an axial deformation of the elastomer part is possible. In the event of a deformation, the volume of the elastomer part of the stator remains the same. An axial deformation of the elastomer part thus leads at the same time to a radial deformation of the elastomer part, as result of which the cross-section of the passage of the elastomer part, in which the rotor is guided, is reduced. In addition to compensating for the stator wear, the pretensioning between stator and rotor can thus also easily be changed, i.e. the adjustment or readjustment of the stator according to the invention can also be used to adapt the pretensioning between stator and rotor of an eccentric screw pump to different operating conditions and operational statuses.

According to the invention, provision is made such that the stator-rotor system comprises an adjusting mechanism for adjusting or readjusting the stator, which comprises two adjustment elements coupled to the stator-rotor system, which are distance-variable relative to one another. In the first working position, the two adjustment elements have a first distance from one another and in a second working position the two adjustment elements have a second distance from one another, wherein the first distance is not equal to the second distance. In the second working position, the cross-section and the length of the elastomer part of the stator are changed compared to the cross-section and the length of the elastomer part in the first working position. The cross-section of the elastomer part, in particular the cross-section of the internal thread of the elastomer part, is important with regard to the pretensioning developed between stator and rotor. In particular, a compression of the elastomer part for example, wherein its length is reduced, brings about an enlargement of the cross-section. In parallel with this, the internal contour of the stator is reduced, as result of which the pretensioning between the stator and the rotor increases. Conversely, stretching of the elastomer part, wherein its length is increased, brings about a reduction in the cross-section. In parallel with this, the internal contour of the stator is increased, as a result of which the pretensioning between the stator and the rotor diminishes.

According to a preferred embodiment, a mechanical coupling and/or connection is present between the adjusting mechanism and the stator, in particular such a mechanical coupling and/or connection is present between the adjusting mechanism and the elastomer part of the stator. By changing the relative distance between the two adjustment elements of the adjusting mechanism, a change in the cross-section and the length of the elastomer part of the stator is brought about.

According to a preferred embodiment, the second distance is less than the first distance, wherein in the second working position the cross-section of the elastomer part of the stator is enlarged compared to the first working position and the length of the elastomer part of the stator is reduced compared to the first working position. In this embodiment, a mutual approach of the adjustment elements brings about an enlargement or increase in the pretensioning between the rotor and the stator of the stator-rotor system. In contrast, spacing-apart of the adjustment elements from one another brings about a reduction of the pretensioning between the rotor and the stator of the stator-rotor system.

According to an alternative embodiment, the second distance is greater than the first distance, wherein in the second working position the cross-section of the elastomer part of the stator is reduced compared to the first working position and the length of the elastomer part of the stator is enlarged compared to the first working position. In this embodiment, a removal of the adjustment elements brings about a reduction of the pretensioning between the rotor and the stator of the stator-rotor system. In contrast, spacing-apart of the adjustment elements from one another brings about an enlargement or an increase of the pretensioning between the rotor and the stator of the stator-rotor system.

According to a preferred embodiment, provision is made such that one of the adjustment elements is arranged stationary on the stator-rotor system and the other adjustment element is arranged position-variable on the stator-rotor system. In particular, the first adjustment element is arranged stationary on the support element or stator casing and the second adjustment element is arranged position-variable on the elastomer part of the stator.

According to a preferred embodiment, provision is made such that the first adjustment element is arranged stationary on a flange at a free end of the support element or stator casing and that the second position-variable adjustment element is arranged at a free end of the elastomer part of the stator. In particular, provision is made such that the distance between the first adjustment element and the second adjustment element can be adjusted by displacing the second position-variable adjustment element parallel to the stator longitudinal axis. As already described above, the free ends of the elastomer part of the stator are not surrounded by the support element or stator casing. By moving the second position-variable adjustment element parallel to the stator longitudinal axis in the direction of the flange at the free end of the support element, the length of the elastomer part is shortened and this compression brings about an enlargement of the cross-section of the elastomer part. By moving the second position-variable adjustment element parallel to the stator longitudinal axis away from the flange at the free end of the support element, the length of the elastomer part is increased and this stretching brings about a reduction in the cross-section of the elastomer part.

The adjustment of the relative distance between the two adjustment elements can take place in different ways. For example, wedge elements can be assigned to each of the two adjustment elements. The wedge elements are in an operative connection with one another, so that a change in the position of one wedge element forces a change in the position of the other wedge element. Whereas the first wedge element assigned to the first stationary adjustment element is displaceable relative to the latter, the second wedge element assigned to the second position-variable adjustment element is fixed stationary on the second adjustment element. A movement of the first wedge element, in particular a displacement of the first wedge element relative to the first adjustment element, wherein the displacement preferably takes place parallel to the stator longitudinal axis, brings about a displacement of the second wedge element and therefore a displacement of the second position-variable adjustment element. In particular, the displacement movement of the second wedge element is orientated roughly orthogonal to the displacement movement of the first wedge element.

According to a further embodiment, a plurality of wedge rings is provided between the two adjustment elements. By rotating the wedge rings against one another, the distance can be varied arbitrarily in a range between a minimum distance and a maximum distance defined by the wedge rings. The rotation of the wedge rings preferably also brings about a rotation of at least one of the adjustment elements parallel to the stator longitudinal axis and leads to a relative movement of the free end of the elastomer part in relation to the free end of the support element.

Alternatively, the use of a spindle with an external thread or a toothed rod can be provided, which is arranged between or on the adjustment elements in such a way that the second position-variable adjustment element can be moved in the direction of the first stationary adjustment element or in the opposite direction away from the first stationary adjustment element. This is possible for example in combination with a toggle lever mechanism. Instead of the spindle, at least one hydraulic or pneumatic hollow cylinder or an adjustment by means of a plurality of threads can also be provided for changing the distance between the two elements.

In addition to the adjusting mechanism comprising two adjustment elements, the invention can in particular comprise a supporting element so that the elastomer part of the stator is at least partially covered and supported at an exposed outer end region, in which the elastomer part is not surrounded by the support element or stator casing. Furthermore, a compensating element may be necessary, in order that at least the majority of the exposed elastomer part is always covered and supported.

According to a preferred embodiment, a supporting and/or compensating element is arranged between the first stationary adjustment element and the second position-variable adjustment element, said supporting and/or compensating element at least partially covering and supporting an exposed end region of the elastomer part. For example, the supporting and/or compensating element can comprise at least two support elements encompassing the elastomer part in a form-fit manner and at least partially guided into one another. One of the support elements is arranged on the first stationary adjustment element and the other support element is arranged on the second position-variable adjustment element. For example, one of the support elements is constituted as a support ring surrounding the end region of the elastomer part and the other support element is constituted as a hollow cylinder and arranged on the flange of the support element or stator casing. The internal diameter of the hollow cylinder is at least slightly larger than the external diameter of the support ring. The support ring is guided in the hollow cylinder according to the cylinder-piston principle. The support ring and the hollow cylinder are arranged on the stator-rotor system in such a way that the hollow cylinder for the most part surrounds the support ring when there is a minimum spacing of the two adjustment elements. When there is a maximum spacing of the two adjustment elements, on the other hand, the hollow cylinder surrounds a region of the support ring facing away from the free end of the elastomer part of the stator only to a small extent. In this way, a radial support of the elastomer part is always ensured in the end region not surrounded by the support element or stator casing.

According to a further embodiment, the support elements have roughly the same internal and external diameter. Each of the support elements comprises fingers which are spaced apart at regular intervals. The support elements are arranged on the stator-rotor system in such a way that the fingers of the one support element are guided in the intermediate spaces between the fingers of the other support element. When there is a minimum spacing of the two adjustment elements, the fingers of the one support element for the most part fill the intermediate spaces between the fingers of the other support element and vice versa. When there is a maximum spacing of the two adjustment elements, on the other hand, only end regions of the fingers of the one support element engage in the intermediate spaces between the end regions of the fingers of the other support element. A radial support of the elastomer part in the end region not surrounded by the support element or stator casing is thus always ensured.

According to a further embodiment, a spring assembly encompassing the elastomer part, for example an undulating spring, or a plurality of elements loosely encompassing the elastomer part is used as a supporting and/or compensating element. Alternatively, the supporting and/or compensating element can also be formed by a material introduced internally and/or externally into the elastomer part and/or deposited on the elastomer part.

Various other adjusting mechanisms can also be used to adjust the distance between the two adjustment elements. For example, it is conceivable to vary the distance between the adjustment elements by means of suitable hydraulically or pneumatically operated adjustment means or by means of suitable mechanical adjustment means.

Furthermore, the invention relates to a method for adjusting or readjusting a stator in a stator-rotor system of an eccentric screw pump, in particular a method for adjusting or readjusting a stator in a previously described stator-rotor system. The relative distance between two adjustment elements arranged on the stator-rotor system is changed here in a targeted manner, as a result of which the cross-section and/or the length of the elastomer part can be adjusted, in order to readjust the latter and/or to adapt it to given operational conditions.

According to an embodiment of the method, the relative distance between the two adjustment elements is reduced in order to increase the cross-section of the elastomer part of the stator and to reduce the length of the elastomer part of the stator, as a result of which the pretensioning between the stator and rotor can be increased. If, on the other hand, the relative distance between the two adjustment elements is increased, the cross-section of the elastomer part of the stator is reduced, whilst the length of the elastomer part of the stator is increased, as a result of which the pretensioning between the stator and rotor can be reduced. Preferably, the distance between the two adjustment elements is changed by the fact that the position of at least one of the adjustment elements is changed or readjusted by a movement parallel to the stator longitudinal axis.

According to an alternative embodiment of the method, the relative distance between the two adjustment elements is increased in order to reduce the cross-section of the elastomer part of the stator and to increase the length of the elastomer part of the stator, wherein the pretensioning between stator and rotor is reduced. If, on the other hand, the relative distance between the two adjustment elements is reduced, the cross-section of the elastomer part of the stator is increased, whilst the length of the elastomer part of the stator is reduced, wherein the pretensioning between stator and rotor is increased.

As an alternative or in addition to the described features, the method can comprise one or more features and/or properties of the device described above. Likewise, the device can alternatively or additionally comprise individual or a plurality of features and/or properties of the described method.

According to an embodiment of the invention, an automation of the stator adjustment is provided. For this purpose, the adjusting mechanism is coupled with a control system and is actuated and controlled by the latter. In particular, the control system comprises at least one sensor for ascertaining actual operating parameters of the stator-rotor system and a control for adjusting the adjusting mechanism. The adjustment of the adjusting mechanism is ascertained on the basis of data measured by sensors, wherein the adjustment of the adjusting mechanism is actuated and/or controlled or monitored by the control.

The control mechanism according to the invention creates an interrelation between various physical operating parameters of the stator-rotor system and the state of wear of the stator or the pretensioning between stator and rotor. For example, an interrelation between the physical operating parameters pressure, flow rate, speed and viscosity and the state of wear of the stator or the pretensioning between stator and rotor is created. The most direct parameter that unites these interrelations with one another is the tension in the elastomer material. This can be determined either directly by a suitable sensor in the elastomer material or can be ascertained indirectly via the reaction force of the elastomer to other components.

With the aid of the control algorithm according to the invention, a correlation is created for example from pressure, flow rate, speed and the required pretensioning and a corresponding adjustment path for the adjustment of the adjusting mechanism is then ascertained, which should be suitable for adjusting the optimum operating point. In particular, the distance to be adjusted between the adjustment means of the adjusting mechanism is calculated. After the automated adjustment of the adjusting mechanism, the physical operating parameters of the eccentric screw pump are again measured and it is ascertained therefrom whether the optimum operating state is achieved. If the measured operating parameters do not correspond to the desired setpoint parameters, an adjustment path is again calculated and the adjusting mechanism is reset, in particular the relative distance between the adjustment means of the adjusting mechanism is readjusted. The second position-variable adjustment element for changing the distance relative to the first stationary adjustment element is preferably actuated by the control.

In the context of the control, a retrieval of the actual operating status of the eccentric screw pump first takes place. Here, at least one physical actual operating parameter concerning the eccentric screw pump and/or at least one physical actual operating parameter concerning the elastomer part of the stator-rotor system and/or at least one physical actual operating parameter of the adjusting mechanism is ascertained by means sensors. The actual operating parameters ascertained by sensors are then compared with known desired setpoint operating parameters. The comparison takes place in particular on the basis of data stored in the control. If, in the comparison, a difference between the actual operating parameters and the setpoint operating parameters is ascertained, a required adjustment of the adjusting mechanism is calculated and the latter is correspondingly actuated and adjusted, which leads to an adjustment or readjustment of the stator, in particular to a change in the cross-section and the length of the elastomer part of the stator.

According to a preferred embodiment, a renewed retrieval of the actual operating status of the eccentric screw pump and a comparison with the setpoint operating parameters takes place following the adjustment of the adjusting mechanism after a defined period of time. The success of the adjustment is checked. If there is still a significant difference between the actual operating parameters and the setpoint operating parameters of the eccentric screw pump, a renewed actuation and adjustment of the adjusting mechanism takes place. If, by adjusting the adjusting mechanism and therefore adjusting or readjusting the stator, the difference between the actual operating parameters and the setpoint operating parameters has been able to be sufficiently reduced, no further adjustment takes place. Instead, the adjusted operational status of the eccentric screw pump is again checked after a defined further period of time by the sensor measurements described above.

If, on the other hand, no difference between the actual operating parameters and the setpoint operating parameters is ascertained at the time of the first retrieval of the actual operating status of the eccentric screw pump, a renewed retrieval of the actual operating status of the eccentric screw pump takes place after a defined period of time by measuring the actual operating parameters and in turn comparing the latter with the setpoint operating parameters. As a result of the regular retrieval at defined time intervals, the stator-rotor system is constantly monitored during the ongoing operation and can be readjusted and adapted in a timely manner.

According to an embodiment of the invention, the pressure, the speed, the temperature and/or the volume flow of the eccentric screw pump is ascertained by means of sensors. Alternatively or in addition, the pretensioning between rotor and stator and/or the reaction forces of the elastomer material of the elastomer part are measured. Furthermore, the position of at least one adjustment element of the adjusting mechanism and/or the relative distance between the adjustment elements of the adjusting mechanism can be ascertained by means of sensors.

With the stator-rotor system and the method for adjusting or readjusting the stator of a stator-rotor system, the wear on a stator can be compensated for easily, quickly and therefore cost-effectively. Furthermore, the adjustment or readjustment of the stator according to the invention can also be used to adapt the pretensioning between the stator and rotor of an eccentric screw pump.

This effect is also utilised to compensate for an expansion of the elastomer, for example due to a raised temperature of the delivered medium or swelling of the elastomer. Friction losses can be minimised by a targeted reduction of the pretensioning force between stator and rotor, as a result of which the energy efficiency can in turn be hugely increased. Furthermore, the breakaway torques when the pump is started can be minimised, i.e. a smaller torque is required to overcome the adhesive friction and to transfer into sliding friction.

The adjustment of the stator can also to be used as a sealing valve when the pump is at a standstill. During the standstill of the pump, the pretensioning is increased, which leads to a seal between the rotor and stator of the eccentric screw pump.

In particular, the efficiency of the pump can be increased with the aid of the stator-rotor system according to the invention, since the backflow of medium can for the most part be minimised.

The adjustment or readjustment of the stator takes place by the interaction of two adjustment elements. A change in the distance of the two adjustment elements from one another brings about a deformation of the elastomer and thus a change in the cross-section and/or the length of the elastomer part of the stator and thus an adjustment or readjustment of the elastomer part of the stator. The position of the two elements can take place over the entire length of the stator and beyond. For example, the first stationary element can be arranged on the flange of the support element or stator casing at one end of the stator-rotor system and the second stationary element can be arranged on the opposite free end of the elastomer part of the stator-rotor system.

BRIEF DESCRIPTION OF THE DRAWINGS

Examples of embodiment of the invention and its advantages are explained in greater detail below with the aid of the appended figures. The size ratios of the individual elements with respect to one another in the figures do not always correspond to the actual size ratios, since some forms are represented simplified and other forms magnified compared to other elements for the sake of better clarity.

DETAILED DESCRIPTION

Identical reference numbers are used for identical or identically acting elements of the invention. Furthermore, for the sake of clarity, only reference numbers that are required for the description of the given figure are represented in the individual figures. The represented embodiments only represent examples as to how the device according to the invention or the method according to the invention can be constituted and do not represent a conclusive limitation.

Figure 2:
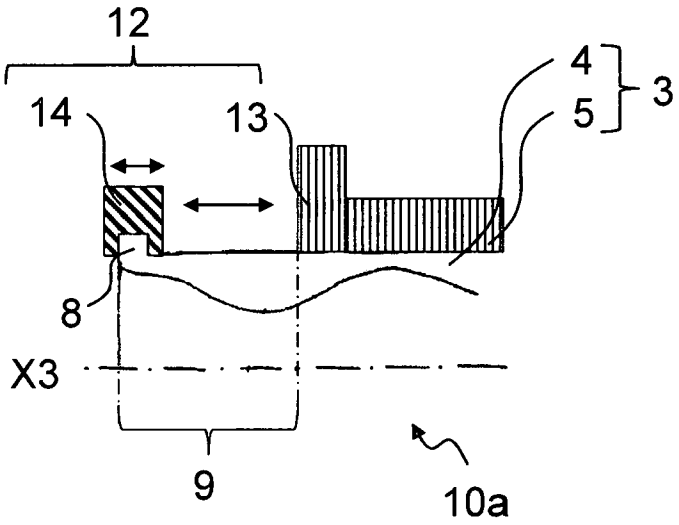
FIG. 2 shows a diagrammatic partial view of a first embodiment of a stator-rotor system according to the invention with an adjusting mechanism.

FIG. 2 shows a diagrammatic partial view of a first embodiment of a stator-rotor system, 10*a* according to the invention with adjusting mechanism 12. Adjusting mechanism 12 comprises a first stationary adjustment element 13 and a second position-variable adjustment element 14. A change in the distance of the two adjustment elements 13, 14 from one another brings about a deformation of the elastomer and therefore a change in the cross-section and/or the length of the elastomer part 4 of stator 3 and therefore an adjustment or readjustment of elastomer part 4 of stator 3. In particular, a flange on stator casing 5 serves as a stationary adjustment element 13 and actuation element arranged at free end 8 of elastomer part 4 serves as a position-variable adjustment element 14. The change in position of position-variable adjustment element 14 is brought about in particular by moving the latter parallel to stator longitudinal axis X3, as a result of which the distance from stationary adjustment element 13 is changed.

Figure 4:
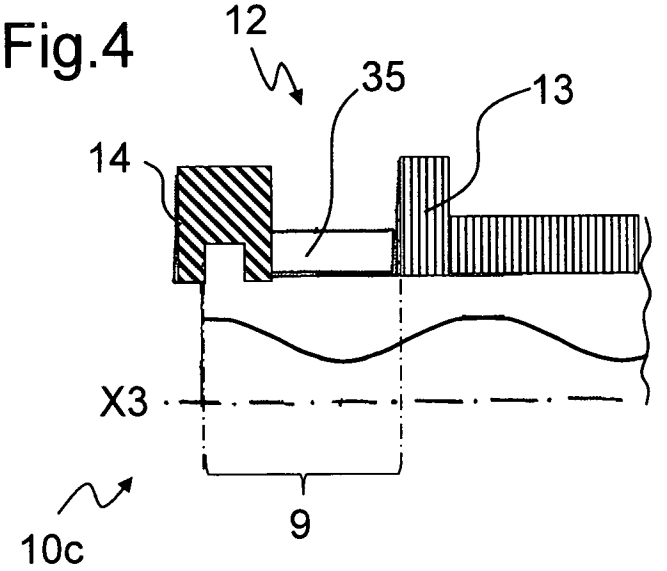
FIG. 4 shows diagrammatically a partial view of a further embodiment of a stator-rotor system according to the invention with an adjusting mechanism.
Figure 3:
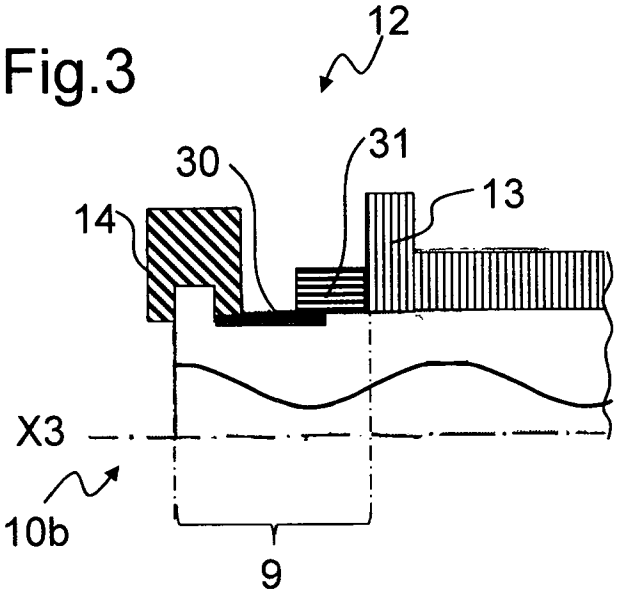
FIG. 3 shows diagrammatically a partial view of a further embodiment of a stator-rotor system according to the invention with an adjusting mechanism.

FIGS. 3 and 4 show diagrammatic partial views of further embodiments of a stator-rotor system 10*b*, 10*c* according to the invention with adjusting mechanism 12.

The change in the distance of the two adjustment elements 13, 14 from one another brings about a deformation of the elastomer and therefore a change in the cross-section and/or the length of elastomer part 4 of stator 3. However, the length of an end region 9 of elastomer part 4 projecting out of stator casing 5 is thus also changed.

End region 9 of elastomer part 4 projecting out of stator casing 5 is preferably at least partially covered and supported by a supporting element, which at least partially covers and supports elastomer part 4 of stator 3 in exposed end region 9 in which elastomer part 4 is not surrounded by stator casing 5. In order to compensate for the change in length of elastomer part 4, the compensating element is also required in order that at least a major part of exposed elastomer part 4 is always covered and supported.

According to the embodiment represented in FIG. 3, two elements 30, 31 encompassing elastomer part 4 in a form-fit manner and guided at least partially into one another are provided, in particular a support ring 30 and a hollow cylinder 31, which provide a support of elastomer part 4 taking account of the changes in length according to the cylinder-piston principle. One of the elements, in particular support ring 30, is arranged and fixed on position-variable adjustment element 14 and the other element, in particular hollow cylinder 31, is arranged and fixed on stationary adjustment element 13. When position-variable adjustment element 14 approaches stationary adjustment element 13, support ring 30 is pushed farther into hollow cylinder 31. When position-variable adjustment element 14 is moved farther away from stationary adjustment elements 13, support ring 30 is withdrawn at least partially from hollow cylinder 31. In particular, the two elements 30, 31 together bring about the supporting of exposed end region 9 and the length compensation of elastomer part 4, i.e. each of the two elements 30, 31 serves both as a supporting element and also as a compensating element.

Figure 13:
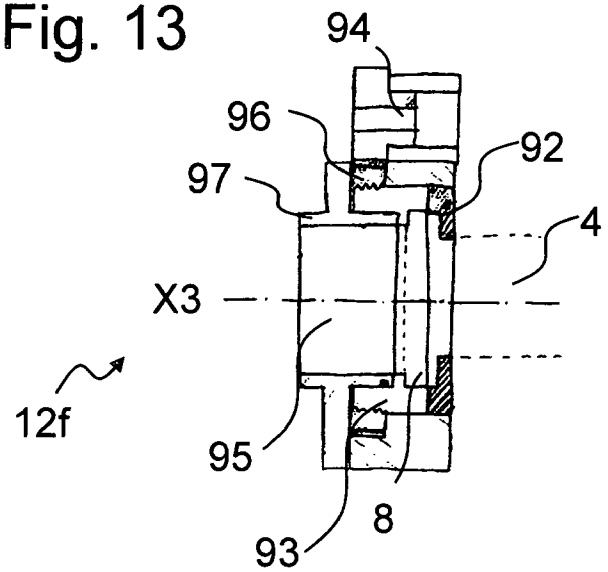

The fixing of an element 30, in particular a support ring 30, encompassing the elastomer part 4 in a form-fit manner, can take place for example on thickened free end 8 of elastomer part 4 and is represented in FIG. 13. Elastomer part 4 is arranged in this stator casing 5. An element 30 in the form of a support ring 30 encompassing elastomer part 4 in a form-fit manner is then arranged in the region of free end 8 of elastomer part 4 and screwed down after fitting. Screwing 40 takes place in particular in the region of the thickened portion of free end 8 of elastomer part 4.

Figure 5:
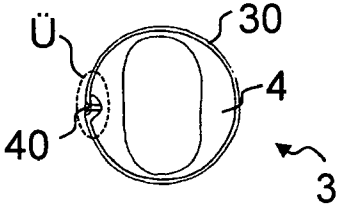
FIG. 5 shows a stator with a support ring in cross-section.

FIG. 5 shows the structure of a support ring 30 arranged around elastomer part 4 of stator 3. Said support ring comprises an overlap and is fixed to elastomer part 4 by means of screwing 40 in the overlap region.

Figure 6:
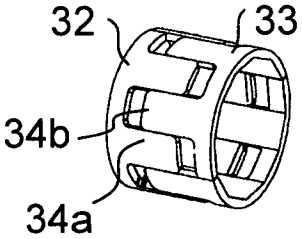
FIG. 6 shows a further supporting/compensating element of an embodiment of the stator-rotor system according to the invention.

FIG. 6 shows a further supporting/compensating system also comprising two elements 32, 33 encompassing elastomer part 4 in a form-fit manner and guided at least partially into one another. Elements 32, 33 each comprise fingers 34*a* and 34*b* spaced apart at regular intervals. The two elements 32, 33 are arranged in such a way that fingers 34*a* of first element 32 engage in the intermediate spaces between fingers 34*b* of second element 33. By displacing elements 32, 33 relative to one another, length changes in elastomer part 4 can thus be compensated for, whilst at the same time the supporting of elastomer part 4 is ensured. This means that, also with this embodiment, each of the two elements 32, 33 serves both as a supporting element and also as a compensating element.

Figure 7:
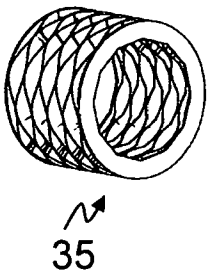
FIG. 7 shows a further supporting/compensating element of an embodiment of the stator-rotor system according to the invention.

FIG. 4 shows an embodiment of a stator-rotor system 10*c* according to the invention with adjusting mechanism 12 with a supporting/compensating element 35 between first stationary adjustment element 13, in particular between stator casing flange, and a second position-variable adjustment element 14, in particular actuation element. Loose elements, for example, can be used as supporting/compensating element 35, which loose elements encompass elastomer part 4 of stator 3, lie between adjustment elements 13, 14 and therefore cover a major part of the exposed outer casing surface of elastomer part 4. According to a further embodiment, a spring assembly encompassing elastomer part 4 of stator 3 can be provided as a supporting/compensating element 35, for example an undulating spring represented in FIG. 7.

According to a further embodiment not represented, elastomer part 4 can be supported at the exposed points also internally and/or externally by a material introduced into elastomer part 4 or deposited on elastomer part 4, an elastomer-fibre composite, for example, being used for this purpose. Since, in this case, the compensation function is also brought about by this material, the length of elastomer part 4 thus supported along stator longitudinal axis X3 (see FIG. 1) must correspondingly be selected such that the region of elastomer part 4 exposed at any given time is always sufficiently supported.

FIGS. 8 to 14 show various embodiments of adjusting mechanisms 12 which can be used within the scope of the invention.

Figure 8:
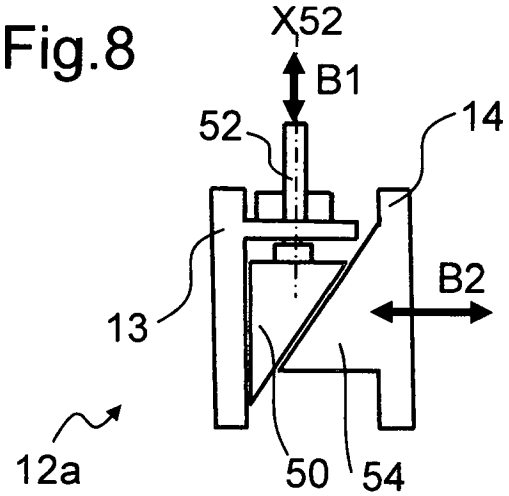

FIG. 8 represents an adjusting mechanism 12*a* in the form of a wedge mechanism, wherein a first wedge element 50 is arranged on first stationary adjustment element 13 and a second wedge element 54 is arranged on second position-variable adjustment element 14. First adjustment element 13 also comprises a spindle 52 with an external thread, said spindle being fastened to first wedge element 50 and guided through a nut 51 with a corresponding internal thread. By rotating spindle 52 about spindle longitudinal axis X52, first wedge element 50 is moved in a first movement direction B1. The movement of first wedge element 50 is transmitted to second wedge element 54 of second adjustment element 14, said second wedge element being in an operative connection with first wedge element 50. This leads to a movement of second adjustment element 14 in second movement direction B2, which is essentially orthogonal to first movement direction B1 of first wedge element 50. The interaction of wedge elements 50, 54 of the two adjustment elements 13, 14 brings about a change in the distance of the two adjustment elements 13, 14 from one another and thus a deformation of the elastomer, in particular a change in the cross-section and/or a change in the length of elastomer part 4.

Figure 9:
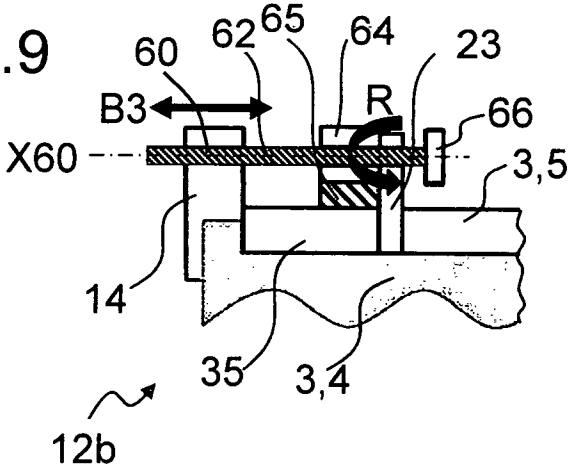
FIGS. 8 to 14 show various embodiments of adjusting mechanisms which can be used within the scope of the invention.

FIG. 9 shows an adjusting mechanism 12*b* in the form of an adjustment by means of a spindle 60. Spindle 60 comprises an external thread 62. Spindle 60 is arranged and mounted rotatably on flange 23 which is arranged stationary on stator casing 5. In particular, spindle 60 is mounted stationary on flange 23, i.e. a rotation of spindle 60 brings about no change in the position of spindle 60 relative to flange 23. Spindle 60 comprises an adjustment shoulder 66. The latter can be constituted for example as a coupling for a motor or can serve as an attachment point for a manual adjustment of spindle 60.

According to an embodiment of the invention, a plurality of spindles (not represented) can be arranged around the outer circumference of stator 3. A first and driven spindle 60 can be coupled mechanically via a gearwheel 64 and a toothed ring 65 or other suitable coupling means to the other, non-driven spindles (not represented) in such a way that all the spindles can be adjusted together.

Figure 1:
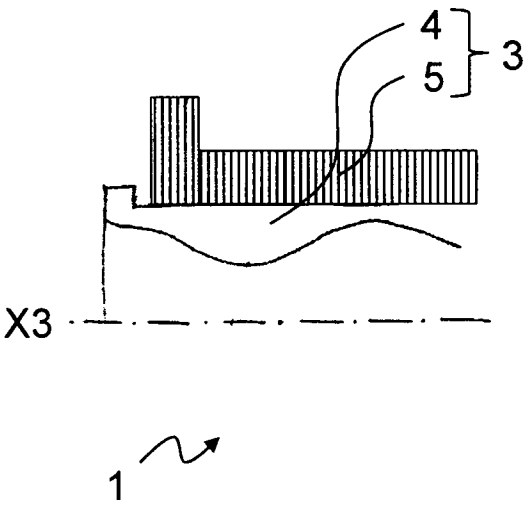
Fig.1 (Prior Art)
FIG. 1 shows a diagrammatic partial view of a known stator-rotor system (prior art).

A second position-variable adjustment element 14 is arranged at the free end of elastomer part 4 of stator 3 (see FIG. 1). A supporting/compensating element 35 is provided between second position-variable adjustment element 14 and flange 23 serving as first stationary adjustment element 13, such as has been described for example in connection with FIGS. 3 to 6.

Second position-variable adjustment element 14 comprises a mounting for spindle 60 with an internal thread (not represented), in which spindle 60 is mounted rotatably, so that a rotation R of spindle 60 about its spindle longitudinal axis X60 brings about a movement of second position-variable adjustment element 14 in a movement direction B3.

Figure 10:
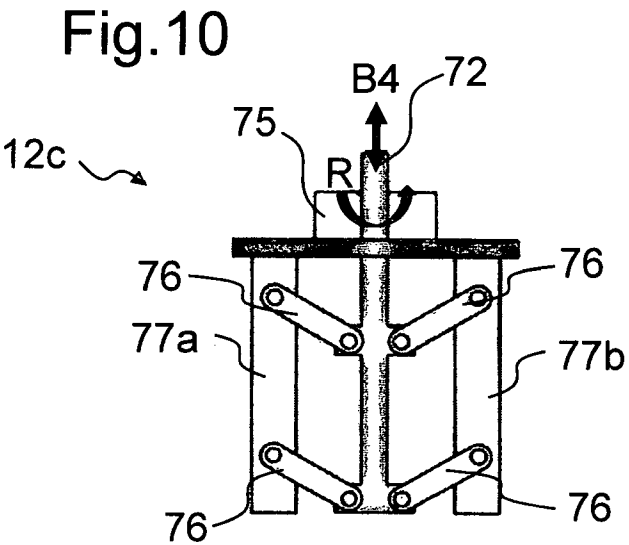

FIG. 10 represents a part of adjusting mechanism 12*c* in the form of a toggle lever. A spindle 72 or toothed rod 73 with an external thread 72 is assigned to an adjustment element 75 in a rotatable manner. Two adjusting members 77*a* and 77*b* are arranged on spindle 72 by means of movably mounted connecting elements 76. One of adjusting members 77*a* is fixed stationary and forms first stationary adjustment element 13. The other adjusting member 77*b* is position-variable and forms second position-variable adjustment element 14. By actuating adjustment element 75, for example by rotation R, spindle 72 and is moved and in particular moved in movement direction B4. This movement is transmitted to adjusting member 77 via movable connecting elements 76, said adjusting members thus being moved closer together or farther apart, wherein position-variable adjusting member 77*b* is in particular moved relative to fixed adjusting member 77*a*.

Figure 11:
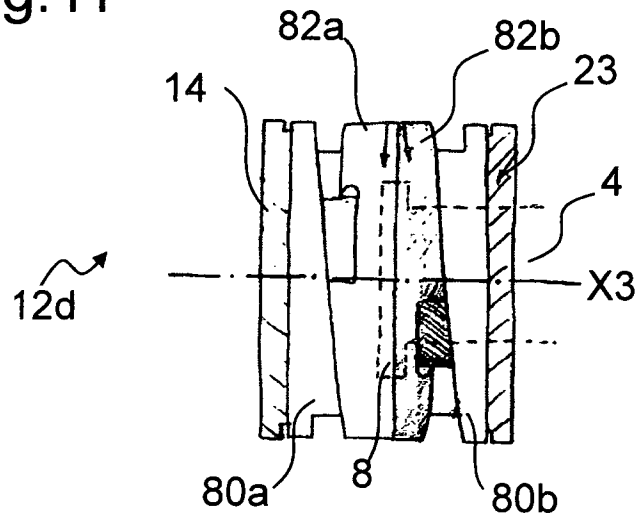

FIG. 11 shows an adjusting mechanism 12*d* in the form of an adjustment by means of wedge rings 80*a*, 80*b*, 82*a*, and 82*b*. Adjusting mechanism 12*d* comprises for example two external wedge rings 80*a*, 80*b* and two internal wedge rings 82*a*, 82*b* and sits on free end 8 of elastomer part 4 of the stator. External wedge ring 80*b* is arranged on a stationary part 13, for example on flange 23 of the stator casing (not represented). Position-variable adjustment element 14 is assigned to external wedge ring 80*a* lying opposite. The two internal wedge rings 82*a*, 82*b* sit on widened free end 8 of elastomer part 4 of the stator and are fixed to the latter. By rotating wedge rings 80*a*, 80*b*, 82*a*, 82*b*, their distance from one another is adjusted and the relative distance between flange 23 of the stator casing and free end 8 of elastomer part 4 of the stator is thus also varied.

Figure 12:
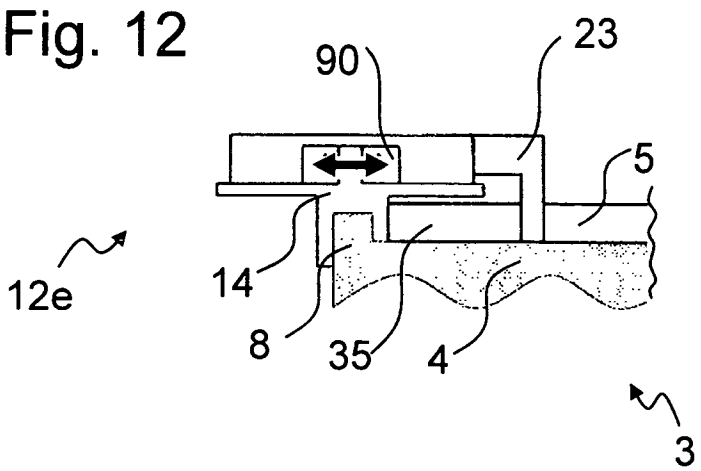

FIG. 12 represents an adjusting mechanism 12*e* by means of a hydraulic or pneumatic hollow cylinder 90. Here, second position-variable adjustment element 14 is again arranged on widened free end 8 of elastomer part 4 of stator 3. Flange 23 on the stator casing 5 represents stationary adjustment element 13 and, in its outer regions, is raised in the direction of free end 8 of elastomer part 4 by a fitted ring or suchlike. At least one hydraulic or pneumatic hollow cylinder is arranged on second position-variable adjustment element 14. By actuating the hollow cylinder, in particular by filling or removing a suitable fluid, second position-variable adjustment element 14 can be moved in the direction of first stationary adjustment element 13 or in the opposite direction. The change in distance between the two adjustment elements 13, 14 brings about the desired deformation of elastomer part 4 and therefore an adjustment or readjustment of elastomer part 4 of stator 3. Similar to FIGS. 2 to 4, a supporting/compensating element 35 is again provided between second position-variable adjustment element 14 and flange 23 serving as first stationary adjustment element 13.

FIG. 13 shows an adjusting mechanism 12*f*, which achieves the adjustment of the relative distance of adjustment elements 13, 14 from one another with the aid of threads. Stationary adjustment element 13 is in an operative connection with position-variable adjustment element 14 by means of a thread arrangement. Position-variable adjustment element 14 is constituted as an adjustment ring 93 and is placed with a thread onto the flange of elastomer part 4. Adjustment ring 93 also accommodates a collar 95, which is fixed by means of a clamping ring 97. A stationary fastening ring is arranged at a free end 8 of elastomer part 4. A driving toothed wheel 94 and a toothed wheel 96 with an internal thread are assigned to fastening ring 92. Toothed wheel 96 with an internal thread in turn engages with position-variable adjustment element 14 or adjustment ring 93. The rotation of the thread of toothed wheels 94, 96 against one another brings about a movement of position-variable adjustment element 14 or adjustment ring 93 along longitudinal axis x3 of the stator (not represented) or of elastomer part 4.

Figure 14:
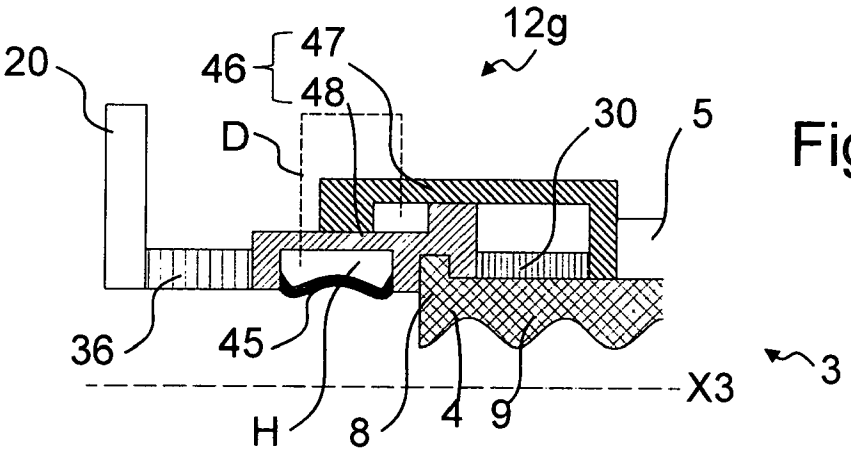

FIG. 14 shows an adjusting mechanism 12*g*, which is constituted as a medium-actuated adjustment system, in particular a hydraulic or pneumatic adjustment system, using a membrane 45. The principle of medium-actuated adjusting mechanism 12*g* involves a modification of the idea of the adjustment by means of a hydraulic cylinder 46 according to FIG. 12. Here, the pretensioning between stator 3 and the rotor (not represented) is adjusted as a function of the pressure of a medium on membrane 45.

Hydraulic cylinder 46 comprises a cylinder part 47 fixed stationary and a cylinder part 48 mounted movably, on which membrane 45 is arranged in such a way that it separates hydraulic fluid H from the medium pumped by means of the eccentric screw pump. Hydraulic cylinder 46 is arranged at free end 8 of elastomer part 4 of stator 3, in particular cylinder part 48 mounted movably is fastened to the elastomer flange and cylinder part 47 fixed stationary is arranged and fixed on a stator casing 5.

Instead of positioning hydraulic cylinder 46 externally by way of a unit and a logic circuit/control, the pressure of the medium of the eccentric screw pump is used. This simplifies the system and reduces costs decisively. The required separation between hydraulic fluid H and medium is implemented by membrane 45 in the example of embodiment represented. When the pump pressure is increased, the pressure is transmitted via membrane 45 to hydraulic fluid H, which leads to a displacement of hydraulic cylinder 46. In particular, a pressure transmission D brings about a displacement of cylinder part 48 mounted movably relative to cylinder part 47 fixed stationary. The resetting of hydraulic cylinder 46 with a reduction in pressure takes place by means of the elastic force of the elastomer of elastomer part 4 and/or by additional components. By means of this interaction, the elastomer of elastomer part 4 is compressed to an extent such that optimum pretensioning between the rotor (not represented) and stator 3 is adjusted as a function of the pump pressure.

In this example of embodiment too, end region 9 of elastomer part 4 projecting out of stator casing 5 is also surrounded at least in sections by an encompassing (supporting) element 30, which at least partially covers and supports elastomer part 4 of stator 3 in exposed end region 9, in which elastomer part 4 is not surrounded by stator casing 5. Furthermore, there is a compensating element 36, which can compensate for the change in length of elastomer part 4 of the stator-rotor system of the eccentric screw pump relative to a stationary flange 20 of the eccentric screw pump.

According to a further embodiment, not represented, provision is made to distribute a plurality of hydraulic cylinders 46 at the circumference of free end 8 of elastomer part 4 of stator 3 and to actuate the latter according to the described principle.

According to a further embodiment, not represented, provision is made to use the end face of elastomer part 4 as a piston, on which the medium pressure of the pumped medium acts directly.

The invention has been described by reference to a preferred embodiment. A person skilled in the art can however envisage that modifications or changes to the invention can be made without thereby departing from the scope of protection of the following claims.

The invention claimed is:

1. A stator-rotor system of an eccentric screw pump comprising:

a stator with an internal thread, the stator comprising a support element and an elastomer part, wherein the support element surrounds the elastomer part in sections around the whole circumference, the stator-rotor system having an adjusting mechanism for adjusting the stator, the adjusting mechanism having a first adjustment element and a second adjustment element, coupled to the stator-rotor system, wherein the first adjustment element and the second adjustment element are distance-variable relative to one another, wherein the first adjustment element and the second adjustment element have a first distance from one another in a first working position and wherein the first adjustment element and the second adjustment element have a second distance from one another in a second working position, wherein the first distance is not equal to the second distance, wherein in the second working position the cross-section and the length of the elastomer part of the stator are changed compared to the cross-section and the length of the elastomer part in the first working position, wherein a supporting and/or compensating element is arranged between the first adjustment element and the second adjustment element, said supporting and/or compensating element at least partially covering and supporting an exposed end region of the elastomer part.

2. The stator-rotor system according to claim 1, wherein a mechanical coupling and/or connection is present between the adjusting mechanism and the stator, wherein a change in the cross-section and the length of the elastomer part of the stator can be brought about by a change in the relative distance between the two first adjustment element and the second adjustment element.

3. The stator-rotor system according to claim 2, wherein the second distance is smaller than the first distance, wherein in the second working position the cross-section of the elastomer part of the stator is enlarged compared to the first working position and the length of the elastomer part of the stator is reduced or wherein the second distance is greater than the first distance, wherein in the second working position the cross-section of the elastomer of the stator is reduced compared to the first working position and the length of the elastomer part of the stator is enlarged compared to the first working position.

4. The stator-rotor system according to claim 1, wherein the second distance is smaller than the first distance, wherein in the second working position the cross-section of the elastomer part of the stator is enlarged compared to the first working position and the length of the elastomer part of the stator is reduced or wherein the second distance is greater than the first distance, wherein in the second working position the cross-section of the elastomer of the stator is reduced compared to the first working position and the length of the elastomer part of the stator is enlarged compared to the first working position.

5. The stator-rotor system according to claim 1, wherein the first adjustment element is arranged stationary on the stator-rotor system and wherein the second adjustment element is arranged position-variable on the stator-rotor system.

6. The stator-rotor system according to claim 1, wherein the first adjustment element is arranged stationary on the support element and wherein the second adjustment element is arranged position-variable on the elastomer part.

7. The stator-rotor system according to claim 6, wherein the first adjustment element is arranged stationary on a flange at a free end of the support element and wherein the second position-variable adjustment element is arranged at a free end of the elastomer part.

8. The stator-rotor system according to claim 1, wherein the adjusting mechanism comprises wedge elements or wedge rings for changing the distance between the first adjustment element and the second adjustment element.

9. The stator-rotor system according to claim 1, wherein the adjusting mechanism comprises a spindle adjustment for changing the distance between the first adjustment element and the second adjustment element or wherein the adjusting mechanism comprises an adjustment by means of a toggle lever mechanism for changing the distance between the two first adjustment element and the second adjustment element or wherein the adjusting mechanism comprises an adjustment by means of a hydraulic or pneumatic hollow cylinder for changing the distance between the first adjustment element and the second adjustment element or wherein the adjusting mechanism comprises an adjustment by means of threads for changing the distance between the first adjustment element and the second adjustment element.

10. The stator-rotor system according to claim 1, wherein the supporting and/or compensating element comprises at least two support elements encompassing the elastomer part in a form-fit manner and at least partially guided into one another, wherein one of the support elements is arranged on the first adjustment element and the other of the support elements is arranged on the second adjustment element, in particular wherein the supporting and/or compensating element comprises a support ring and a hollow cylinder, wherein the support ring is guided in the hollow cylinder according to the cylinder-piston principle or wherein the at least two elements each comprise fingers spaced apart at regular intervals, which are guided into one another, wherein the fingers of the one element are guided into intermediate spaces between the fingers of the other element.

11. The stator-rotor system according to claim 1, wherein the supporting and/or compensating element is formed from a spring assembly encompassing the elastomer part or wherein the supporting and/or compensating element is formed from an undulating spring or wherein the supporting and/or compensating element is formed from a plurality of elements loosely encompassing the elastomer part or wherein the supporting and/or compensating element is formed by a material introduced internally and/or externally into the elastomer part and/or deposited on the elastomer part.

12. A system for adjusting a stator-rotor system of an eccentric screw pump comprising:

a stator with an internal thread, the stator comprising a support element and an elastomer part, wherein the support element and the elastomer part are separate parts and wherein the support element surrounds the elastomer part in sections, the stator-rotor system having an adjusting mechanism for adjusting the stator, which adjusting mechanism has at least two adjustment elements, wherein the relative distance between the two adjustment elements is adjusted in order to adjust the cross-section and the length of the elastomer part of the stator, and an element arranged between the two adjustment elements, said element at least partially covering an exposed end region of the elastomer part.

13. The system according to claim 12, wherein the relative distance between the two adjustment elements is adjusted in order to adapt the cross-section and the length of the elastomer part of the stator.

14. The system according to claim 13, wherein the relative distance between the two adjustment elements is reduced in order to increase the cross-section of the elastomer part of the stator and to reduce the length of the elastomer part of the stator or wherein the relative distance between the two adjustment elements is increased in order to reduce the cross-section of the elastomer part of the stator and to increase the length of the elastomer part of the stator.

15. The system according to claim 13, wherein the relative distance between the two adjustment elements is reduced in order to reduce the cross-section of the elastomer part of the stator and to increase the length of the elastomer part of the stator or wherein the relative distance between the two adjustment elements is increased in order to increase the cross-section of the elastomer part of the stator and to reduce the length of the elastomer part of the stator.

16. The system according to claim 12, wherein the relative distance between the two adjustment elements is reduced in order to increase the cross-section of the elastomer part of the stator and to reduce the length of the elastomer part of the stator or wherein the relative distance between the two adjustment elements is increased in order to reduce the cross-section of the elastomer part of the stator and to increase the length of the elastomer part of the stator.

17. The system according to claim 12, wherein the relative distance between the two adjustment elements is reduced in order to reduce the cross-section of the elastomer part of the stator and to increase the length of the elastomer part of the stator or wherein the relative distance between the two adjustment elements is increased in order to increase the cross-section of the elastomer part of the stator and to reduce the length of the elastomer part of the stator.

* * * * *